US009290946B1

(12) United States Patent
Marsh et al.

(10) Patent No.: US 9,290,946 B1
(45) Date of Patent: Mar. 22, 2016

(54) METHODS AND DEVICES FOR ALIGNING AND COUPLING A ROOFING PROFILE TO A ROOF

(71) Applicant: JOHNS MANVILLE, Denver, CO (US)

(72) Inventors: Henry Marsh, East Dundee, IL (US); William Runyon, Painesville, OH (US)

(73) Assignee: Johns Manville, Denver, CO (US)

( * ) Notice: Subject to any disclaimer, the term of this patent is extended or adjusted under 35 U.S.C. 154(b) by 0 days.

(21) Appl. No.: 14/469,115

(22) Filed: Aug. 26, 2014

(51) Int. Cl.
*E04D 15/02* (2006.01)
*E04D 15/00* (2006.01)

(52) U.S. Cl.
CPC ..... *E04D 15/025* (2013.01); *E04D 15/00* (2013.01)

(58) Field of Classification Search
CPC ..... E04D 15/025; E04D 15/00
See application file for complete search history.

(56) References Cited

U.S. PATENT DOCUMENTS

| | | | | |
|---|---|---|---|---|
| 3,201,874 | A * | 8/1965 | Christy | 33/613 |
| 4,102,285 | A * | 7/1978 | Martin et al. | 248/165 |
| 4,834,828 | A * | 5/1989 | Murphy | 156/359 |
| 5,522,149 | A * | 6/1996 | Meyer | 33/646 |
| 5,737,892 | A * | 4/1998 | Greenberg | 52/469 |
| 5,775,036 | A * | 7/1998 | Stanley, Sr. | 52/127.2 |
| 6,354,055 | B1 * | 3/2002 | Shaw et al. | 52/712 |
| 6,385,859 | B1 * | 5/2002 | Varney | 33/613 |
| 6,418,695 | B1 * | 7/2002 | Daudet et al. | 52/677 |
| 6,536,498 | B1 * | 3/2003 | Srinivasan et al. | 156/497 |
| 6,537,402 | B2 * | 3/2003 | Pate et al. | 156/71 |
| 6,554,947 | B2 * | 4/2003 | Pfotenhauer et al. | 156/304.1 |
| 7,152,338 | B2 * | 12/2006 | Thompson et al. | 33/613 |
| 7,686,056 | B2 * | 3/2010 | Peterson | 156/574 |
| 8,057,631 | B2 * | 11/2011 | Peterson | 156/308.2 |
| 8,322,113 | B2 * | 12/2012 | Shapiro et al. | 52/746.11 |
| 8,474,217 | B2 * | 7/2013 | Paton | 52/749.1 |
| 8,601,705 | B2 * | 12/2013 | Bierman | 33/613 |
| D702,533 | S * | 4/2014 | Noturno | D8/354 |
| 8,726,611 | B2 * | 5/2014 | Swei et al. | 52/746.11 |
| 8,915,284 | B2 * | 12/2014 | Korf et al. | 156/574 |
| 2005/0117999 | A1 * | 6/2005 | Lillegard | 414/10 |
| 2007/0068115 | A1 * | 3/2007 | Ouellette et al. | 52/749.1 |
| 2008/0236093 | A1 * | 10/2008 | Coleman | 52/749.1 |
| 2009/0100694 | A1 * | 4/2009 | Hooks | 33/645 |
| 2009/0100792 | A1 * | 4/2009 | Kassem | 52/749.12 |
| 2009/0146354 | A1 * | 6/2009 | Metroyanis | 269/43 |
| 2010/0083610 | A1 * | 4/2010 | King | 52/749.1 |
| 2011/0214389 | A1 * | 9/2011 | Paton | 52/749.1 |
| 2011/0219715 | A1 * | 9/2011 | Shapiro et al. | 52/309.1 |
| 2013/0000246 | A1 * | 1/2013 | Bourelle | 52/745.21 |

(Continued)

FOREIGN PATENT DOCUMENTS

FR 2964985 A1 * 3/2012

*Primary Examiner* — Rodney Mintz
(74) *Attorney, Agent, or Firm* — Robert D. Touslee

(57) ABSTRACT

A roofing profile installation guide includes a rectangular bottom skid having a front edge, a back edge, and opposing longitudinal side edges. A first side rail and a second side rail are attached to the opposing longitudinal side edges and a front rail is attached to the front edge of the bottom skid. A guide rail is attached to the first side rail. The guide rail is configured to contact a first roofing profile that is attached to a roof surface as the bottom skid is moved atop the roof surface to maintain an orientation of the bottom skid relative to the first roofing profile and thereby, via the second side rail, align a second roofing profile with the first roofing profile atop the roof surface. The second roofing profile is unattached to the roof surface prior to alignment of the two roofing profiles.

19 Claims, 6 Drawing Sheets

(56) References Cited

U.S. PATENT DOCUMENTS

2015/0089885 A1* 4/2015 Wakebe ..... E04D 1/18
52/105

2015/0096255 A1* 4/2015 Sukle et al. ..... 52/506.01

2015/0184389 A1* 7/2015 Ekmekci ..... E04H 7/30
52/630

* cited by examiner

METHODS AND DEVICES FOR ALIGNING AND COUPLING A ROOFING PROFILE TO A ROOF

BACKGROUND OF THE INVENTION

The embodiments described herein provide devices, systems, and methods related to attaching roofing features to a roof's surface by quickly and conveniently aligning the roofing features atop the roof's surface.

Roof surfaces often include one or more roofing features, such as seams, seam-tape, layout lines, and the like. These features may be aligned and/or attached to the roof's surface for various structural and/or aesthetic purposes. A specific example of such a roofing feature is a roofing profile that is typically aligned atop a roofing surface and attached thereto. A specific type of roofing surface that employs such roofing profiles includes those constructed of thermoplastic materials, such as thermoplastic polyolefin (TPO), polyvinyl chloride (PVC), and the like. Other similar types of roofing surfaces include those constructed of rubber materials, such as ethylene propylene diene monomer (EPDM), and the like.

Thermoplastic roofing systems provide various advantages over other types of roofing systems, such as excellent weatherability, resistance to puncture and tears, resistance to chemicals, grease, and UV light; high reflectivity and/or emissivity; long term strength and flexibility; and the like. These roofing systems are typically easy to install and/or otherwise generally desirable. These roofing structures, however, may be rather uniform in appearance and, thus, may have limited aesthetic appeal. To increase the aesthetic appeal of these roofing systems, roofing profiles, which are generally long strips of a plastic or metallic material, are often aligned and adhered to the roof's surface. The roofing profiles are usually aligned at repeated intervals so that the profiles have a predetermined spacing between adjacent profiles. Currently, alignment of the profiles is typically done manually, requiring an installer to measure and layout chalk lines atop the roof surface for each profile. Since these roofing profiles may be desired to increase the aesthetic appeal of a roofing system, more convenient methods and devices of aligning and/or attaching the roofing profiles to the roof's surface are desired.

BRIEF SUMMARY OF THE INVENTION

Embodiments of the invention provide methods, devices, and systems related to aligning and/or coupling of roofing profiles atop a roof surface. In one aspect, a roofing profile installation guide includes a rectangular bottom skid having a front edge, a back edge, and opposing longitudinal side edges. A first tapered side rail and a second tapered side rail are attached to the opposing longitudinal side edges of the rectangular bottom skid. A tapered front rail is also attached to the front edge of the rectangular bottom skid. A guide rail is attached to the first tapered side rail. The guide rail is configured to contact a first roofing profile that is attached to a roof surface as the rectangular bottom skid is moved atop the roof surface in order to maintain an orientation of the rectangular bottom skid relative to the first roofing profile and thereby, via the second tapered side rail, align a second roofing profile with the first roofing profile atop the roof surface. The second roofing profile is unattached to the roof surface prior to alignment of the first and second roofing profiles.

In some embodiments, a bottom surface of the guide rail is offset from a bottom surface of the rectangular bottom skid and/or a top surface of the guide rail is offset from a top surface of the first tapered side rail. In some embodiments, the guide rail has a hooked or curved profile that allows the guide rail to be positioned over a top end of the first roofing profile. A tapered portion of the first and second tapered side rails may taper inward toward a center of the rectangular bottom skid. A tapered portion of the tapered front rail may taper outward and away from a center of the rectangular bottom skid so that an inward facing surface of the tapered front rail is configured to be contacted by a foot of a user to move the rectangular bottom skid atop the roof surface.

In some embodiments, an outer surface of the second tapered side rail may be configured to contact an installation machine that couples the second roofing profile with the roof surface. The outer surface of the second tapered side rail may be roughly orthogonal with a bottom surface of the rectangular bottom skid.

According to another aspect, a roofing profile guide includes a bottom member having a front edge, a back edge, and two side edges, and a front rail attached to the front edge of the bottom member. A guide rail is attached to one of the side edges of the bottom member. The guide rail is configured so that as the bottom member is moved across a roof surface, the guide rail contacts a first roofing profile attached to the roof surface to maintain a lateral spacing between the first roofing profile and a second roofing profile in order to align the second roofing profile with the first roofing profile atop the roof surface.

A bottom surface of the guide rail may be offset from a bottom surface of the bottom member. The guide rail may have a hooked or curved top end that is positionable atop the first roofing profile. In some embodiments, the roofing profile guide may also include a first rail and a second rail with each rail being coupled with one of the two side edges. In such embodiments, the guide rail may be attached to the first rail and/or the second rail.

In some embodiments, an inward facing surface of the front rail may be configured to effect movement of the bottom member across the roof surface upon contact by a user's foot or other member. In some embodiments, an outer surface of one of the two side edges may be configured to guide an installation machine atop the roof surface. The installation machine may be configured to align and/or couple the second roofing profile with the roof surface. In such embodiments, the second roofing profile may be laterally offset from the one of the two side edges via the installation machine.

According to another aspect, for a roofing profile guide that includes a bottom skid having a front edge, a back edge, a first side edge, and a second side edge; a front rail attached to the front edge; and a guide rail attached to the first side edge; a method of attaching a roofing profile to a roof surface includes positioning the guide rail adjacent a first roofing profile that is attached to the roof surface and positioning a second roofing profile adjacent the second side edge of the roofing profile guide. The method also includes moving the roofing profile guide across the roof surface so that the guide rail of the roofing profile guide moves along the first roofing profile to maintain an orientation of the roofing profile guide relative to the first roofing profile, and aligning the second roofing profile with the first roofing profile via the second side edge of the roofing profile guide. The method further includes attaching the second roofing profile with the roof surface.

BRIEF DESCRIPTION OF THE DRAWINGS

Embodiments of the present invention are described in conjunction with the appended figures.

Figure 1:
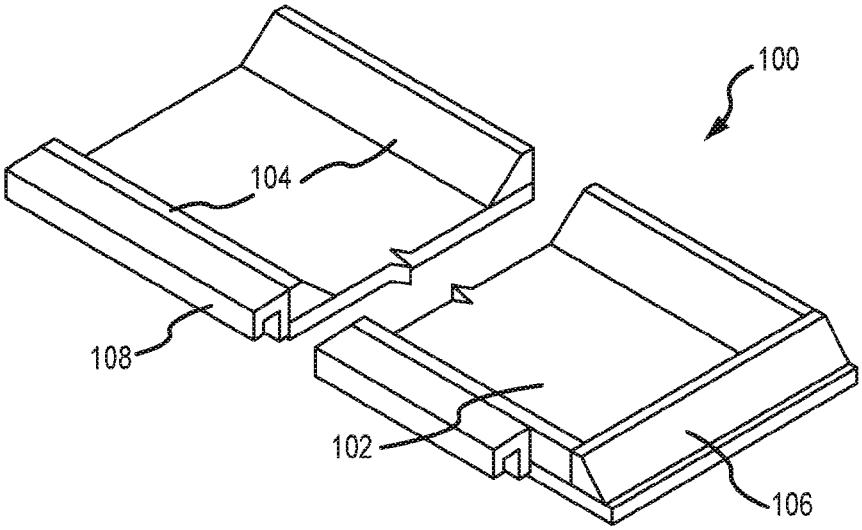
FIG. 1 illustrates a perspective view of a guide that may be used to align adjacent roofing profiles atop a roof surface.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the embodiments will provide those skilled in the art with an enabling description for implementing one or more embodiments. It being understood that various changes may be made in the function and arrangement of elements without departing from the spirit and scope of the invention as set forth in the appended claims. Specific details are given in the following description to provide a thorough understanding of the embodiments. However, it will be understood by one of ordinary skill in the art that the embodiments may be practiced without these specific details.

As used herein the terms roofing feature and roofing profiles generally refer to a feature that is applied atop a roofing surface, normally for aesthetic appeal and/or functional purposes (hereinafter roofing profile). A specific example of a roofing profile includes an elongate or longitudinal strip of material that is applied to the roof surface at repeated intervals for aesthetic and/or functional purposes. Such roofing profiles commonly are constructed of metal, plastic, rubber, and the like. A common type of roofing profile includes a long strip of thermoplastic material (e.g., TPO, PVC, and the like) that may be adhered to a thermoplastic roofing membrane to provide aesthetic appeal, such as those described in U.S. patent application Ser. No. 12/721,694, filed Mar. 11, 2010, titled "Thermoplastic Roofing System" and U.S. patent application Ser. No. 14/045,028, filed Oct. 3, 2013, titled "Composite Profile Structure for Roofing Applications", the entire disclosures of which are incorporated by reference herein.

Although the disclosure herein generally describes using the embodiments for aligning and/or attaching roofing profiles to a roof's surface, it should be realized that the embodiments are not limited to such use. For example, the embodiments may be used to align various other features atop a roof's surface, such as seams, seam-tapes, layout lines, and the like. Similarly, for convenience in describing the embodiments, the disclosure herein generally describes the embodiments as being used on or for roofing membranes. It should be realized, however, that the embodiments may find usefulness on various other roof surfaces, such as tarpaper, gravel, asphalt, oriented strand board (OSB), and the like.

Roof surfaces or systems may include a variety of materials. A common type of roof surface or system includes single ply roofing membranes that are made of thermoplastic polyolefin (TPO), polyvinyl chloride (PVC), ethylene propylene diene monomer (EPDM), and the like (hereinafter roofing membrane). These roofing membranes provide various benefits or advantages compared with other roofing materials, such as excellent weatherability; resistance to puncture and tears; resistance to chemical, grease, and UV light; high reflectivity and/or emissivity to keep buildings cool and lower power costs; long term strength and flexibility; and the like. These roofing membranes also provide a watertight seal to underlying structures of the building. These roofing membranes are commonly applied or coupled with a roof surface using various means, such as adhesion, mechanically fastening, ballasting, and the like with the seams between individual roofing membranes heat welded or otherwise coupled together.

The roofing system resulting from the coupled roofing membranes is typically flat. To enhance the aesthetic appeal of the roofing system, roofing profiles or other features, may be attached to roofing membranes via adhesion, heat welding, mechanically fastening, and the like. The roofing profiles may provide the roofing system with a visually appealing architectural seam appearance. Currently, alignment of the roofing profiles atop a roofing system's surface is typically achieved manually. For example, an installer commonly is required to measure and layout chalk lines atop the roofing system's surface for each profile. The roofing profiles may then be aligned with the chalk lines and coupled with the roof's surface via heat welding, adhesive bonding, mechanically fastening, and the like. The above method of attaching the roofing profiles can be time consuming and/or otherwise difficult.

A common roofing system and roofing profile structure includes the use of thermoplastic material roofing membranes and thermoplastic roofing profiles, such as TPO. The thermoplastic roofing membranes are typically aligned atop the roof's surface and heat welded together. The roofing profiles are then aligned atop the coupled thermoplastic roofing membranes, such as by using the conventional method described above, and subsequently heat welded atop the thermoplastic roofing membranes. The resulting roofing system is an aesthetically pleasing and durable roofing system.

The embodiments described herein enable quick and easy alignment and coupling of roofing profiles atop a roofing surface. The embodiments allow an attached roofing profile to be used as a reference in aligning additional roofing profiles atop the roof. The roofing profiles may be attached to the roofing system during the alignment process. The alignment and coupling of the roofing profiles is achieved via a jig or alignment guide. The jig or guide is configured to slide atop the roof in contact with an attached roofing profile. Specifically, one side of the jig or guide slides along the attached roofing profile while an opposite side of the guide or jig is used to align another roofing profile. In some embodiments, the opposite side of the guide or jig contacts an attachment machine that couples the roofing profile with the roof surface.

In such embodiments, the roofing profile is aligned and attached to the roof simultaneously.

The guide or jig is configured to be slid atop the roof surface via contact with an installer's foot or hand. For example, the guide or jig includes a lipped front surface that an installer may contact with a heel or other member to pull the guide or jig across the roof's surface. In this manner, the installer may simultaneously operate the installation machine and slide the guide or jig atop the roof surface. The guide or jig may also include a hooked or lipped portion that is positionable around the attached roofing profile to aid in maintaining contact between the guide or jig and the attached roofing profile.

Having described various aspects of the guide or jig generally, additional aspects will be realized with references to the description of the drawings herein below. It should be realized that the description below is of a specific embodiment and that the invention is not limited to any specific feature and/or that various aspects of the invention may be changed or modified.

Referring now to FIG. 1, illustrated is a perspective view of a guide or jig 100 (hereinafter guide 100) for aligning and installing roofing profiles atop a roof surface. Guide 100 includes a rectangular shaped bottom skid 102 having a front edge 106, a back edge opposite the front edge, and opposing longitudinal side edges 104. Each longitudinal side edge 104 includes a tapered side rail (also numbered 104) that extends longitudinally a long a majority or all of the longitudinal length of the rectangular shaped bottom skid 102. The tapered side rails 104 are constructed so that a tapered portion of the tapered side rails tapers inward toward a center of the rectangular bottom skid 102. This configuration of the tapered side rails 104 results in an outer surface of the side rails and longitudinal side edges 104 having a roughly vertical configuration relative to the roof surface. The roughly vertical configuration of the longitudinal side edges 104 enables the side edges to abut a profile installation machine and/or allows a guide rail 108 to be easily coupled with one of the side edges 104 as described hereinbelow.

Guide 100 also includes a tapered front rail 106 that is attached to the front edge of the rectangular bottom skid 102. Unlike the tapered side rails of the longitudinal side edges 104, a tapered portion of the tapered front rail 106 tapers outward away from the center of the rectangular bottom skid 102. This configuration of the tapered front rail 106 results in an inward facing surface of the tapered front rail 106 being roughly vertical or otherwise having a lipped configuration that can be contacted to move the guide 100 about the roof's surface as described herein. To move the guide 100 atop the roof surface, an installer may easily contact the vertical or lipped inner surface of the tapered front row 106 and pull the guide 100 atop the roof surface.

As briefly described above, a guide member or rail 108 (hereinafter guide rail 108) is attached to one side of the longitudinal side edges 104. As shown in FIG. 1, the guide rail 108 extends longitudinally along the majority of the longitudinal side edge 104, and in some embodiments may extend along the entire length of the longitudinal side edge 104. In a specific embodiment, the guide rail 108 may extend to adjacent the tapered front rail 106, but along less than the entire longitudinal length of the rectangular bottom skid 102. The guide rail 108 is configured to contact and slide along a roofing profile that is attached to the roof's surface as the rectangular bottom skid 102 is moved atop the roof surface.

Contact between the guide rail 108 and the attached roofing profile maintains an orientation of the guide/rectangular bottom skid 102 relative to, or with respect to, the attached roofing profile. Since the orientation of the guide 100 is maintained relative to the attached roofing profile, additional roofing profiles may be aligned with the attached roofing profile atop the roof surface. For example, as the rectangular bottom skid 102 is slid atop the roof surface with the guide rail 108 in contact with the attached roofing profile, an additional roofing profile that is unattached with the roof surface may be aligned with the attached roofing profile by positioning the additional roofing profile adjacent the side edge 104 opposite the guide rail 108. In some embodiments, the additional attached roofing profile may contact the side edge 104 opposite the guide rail 108 to align the additional unattached roofing profile with the attached roofing profile, or as described in greater detail below, an installation machine may contact the side rail 104 opposite the guide rail 108 and in turn align the unattached roofing profile with the attached roofing profile.

Although FIG. 1 illustrates a guide 100 including tapered side rails that are attached to the longitudinal side edges 104, it should be realized that in other embodiments guide 100 may include a single tapered side rail and/or a side rail having a different configuration (i.e., a non-tapered configuration). In still other embodiments, the tapered side rails may be replaced entirely by one or more guide rails 108. The guide 100 may similarly exclude a front rail 106, or the front rail 106 may be replaced by a different component that aids in moving the guide 100 atop the roof surface. Similarly, although not shown, in some embodiments, a bottom surface of the bottom skid 102 may include wheels or a material having a low coefficient of friction to ease movement of the skid 102 across the roof's surface.

Figure 2:
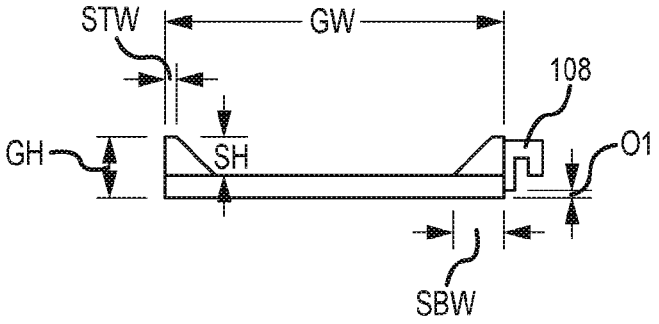
FIG. 2 illustrates a rear end view of the guide of FIG. 1.

Referring now to FIG. 2, illustrated is a rear view of the guide 100. FIG. 2 illustrates the tapered side edges 104 positioned atop the top surface of the rectangular bottom skid 102. As shown in FIG. 2, a tapered portion of the tapered side edges 104 tapers inward toward a center of the rectangular bottom skid 102, while the outer edges or surfaces of the side edges 104 have a roughly vertical or orthogonal configuration relative to the rectangular bottom skid 102 and roof surface. The guide rail 108 is attached to one of the tapered side edges 104. The guide 100 has a width GW that may be varied to accommodate a desired spacing between adjacent roofing profiles. For example, width GW may be about 16 inches so that the resulting spacing between adjacent roofing profiles is about 20 inches when accounting for an additional spacing resulting from the use of an installation machine. The width GW is commonly between 6 and 24 inches, although other sizes may be employed.

Guide 100 similarly includes a height GH that corresponds to the height of a common roofing profile. In some embodiments, the height GH may be between about 1 and 6 inches, although a height of between about 2 and 4 inches is more common. In a specific embodiment the height GH of guide 100 may be between about 2 and 2½ inches. The tapered side rails 104 may have a height SH of between about 1 and 4 inches, and more commonly between about 1 and 2 inches. The tapered side rails 104 may similarly have a bottom width SBW and a top width STW. Bottom width SBW may be between 1 to 4 inches, and more commonly between about 1 and 2 inches, while top width STW is typically less than 1 inch and more commonly less than ½ inch. The tapered side rails 104 may tapered downward at an angle of between about 30 and 60°, and more commonly about 45°.

Figure 3A:
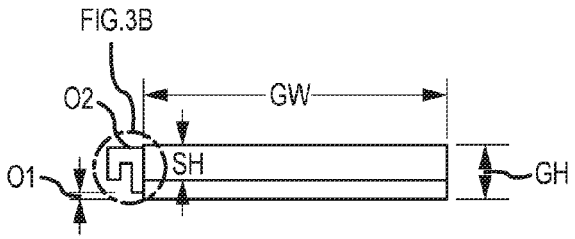
FIG. 3A illustrates a front end view of the guide of FIG. 1.

As shown in FIGS. 2 and 3, the guide rail 108 is attached to one of the longitudinal side edges 104 so as to be offset from a bottom edge and/or a top edge of the guide 100. Specifically, a bottom surface of the guide rail 108 is offset O1 from a bottom surface of the rectangular bottom skid 102. A top surface of the guide rail 108 may similarly be offset O2 from a top surface of the tapered side rail 104. The offset O1 between the bottom surface of the guide rail 108 and the bottom surface of the rectangular bottom skid 102 allows a flange or lateral edge of an attached roofing profile, such as those shown in FIGS. 4A and 4B, to be positioned vertically under the guide rail 108 as the guide 100 is slid across the roof surface with the guide rail 108 in contact with the roofing profile. This configuration (i.e., the flange or edge of the roofing profile positioned under the guide rail 108) allows a hooked portion of the guide member 108 to be positioned over the attached roofing profile without substantially kinking or bending the attached roofing profile. Stated differently, the offset configuration of the guide rail 108 and rectangular bottom skid 102 allows the rectangular bottom skid 102 to be positioned laterally closer to the attached roofing profile since the flange or lateral edge of the roofing profile is positionable under the bottom surface of the guide rail 108.

In some embodiments, the offset O1 between the bottom surface of the guide rail 108 and the bottom surface of the rectangular bottom skid 102 may be between about 1/16 and ½ inch, although an offset O1 of about 3/16 inch is more common. Similarly, the offset O2 between the top surface of the guide rail 108 and the top surface of the tapered side rail 104 may be between about 1/16 and ¼ inch, although other offset O2 values are possible. In some embodiments, the top surface of the guide rail 108 is substantially flush or even with the top surface of the tapered side rails 104 so that no appreciable offset O2 between the two components is apparent.

Figure 3B:
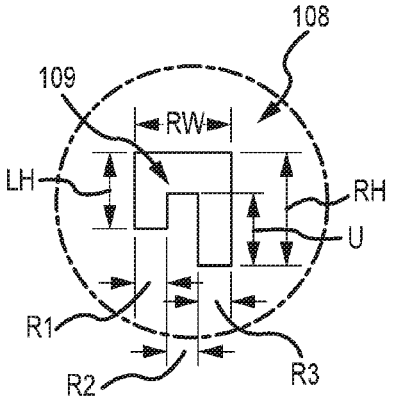
FIG. 3B illustrates an enlarged end view of a guide rail of the guide of FIG. 1.

Referring now to FIG. 3B, illustrated is an enlarged end view of the guide rail 108. The enlarged end view of guide rail 108 illustrates the hooked or curved configuration from the guide rail 108. The hooked or curved configuration of the guide rail 108 allows the guide rail to be positioned over a top end of the attached roofing profile, which helps maintain contact between the guide rail 108 and the attached roofing profile as the guide 100 is slid atop the roof surface. In some embodiments, the guide rail 108 has a height RH of between about 1 and 3 inches, and more commonly between about 1 and 2 inches, which corresponds to a common height of roofing profiles. The guide rail 108 similarly has a width RW of between 1 and 3 inches, and more commonly between about 1 and 2 inches. A distal end or member of the guide rail 108 may extend vertically downwards to create the hooked or curved configuration and may have a height LH of between about 1 and 2 inches, and more commonly less than about 1½ inches. The distal end or member of guide rail 108 may also have a width R1 of less than 1 inch, and more commonly about ½ inch. A proximal end or member of the guide rail 108 may similarly have a width R3 of less than 1 inch, and more commonly about ½ inch.

The configuration of the distal and proximal ends or members results in the guide rail 108 having a central channel or groove 109 with a height U of between 1 and 1½ inch and a width R2 of about ½ inch. The height U and width R2 of the central channel or groove 109 corresponds to the height and width of a central portion of common roofing profiles. The central channel or groove 109 of guide rail 108 allows the guide rail 108 to be positioned over the top end of the roofing profiles. It should be realized that the above described dimensions of the guide 100 and/or one or more of the components thereof (e.g., guide rail 108) are provided for illustrative purposes only and may be modified or changed according to the roofing profiles used and/or according to a desired spacing between adjacent roofing profiles.

Figure 4A:
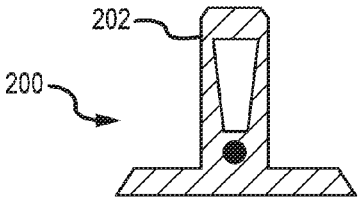
FIGS. 4A-B illustrate end views of roofing profiles that may be aligned with a guide as described herein.
Figure 4B:
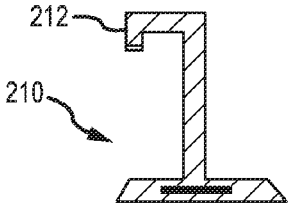

Referring now to FIGS. 4A-B, illustrated are embodiments of roofing profiles that may be aligned atop a roof surface using guide 100. It should be realized that the roofing profiles of FIGS. 4A-B are illustrative of a variety of roofing profiles that may be aligned using guide 100. FIG. 4A illustrates a first roofing profile 200 having a central portion 202 that extends vertically from horizontally oriented flanges. Central portion 202 has a rectangular configuration. As descried briefly above, the central channel or groove 109 of guide rail 108 is configured to be positioned over the top end of central portion 202. The bottom surface of the guide rail 108 is offset O1 from the bottom surface of the skid 102 so that the horizontally oriented flanges of roofing profile 200 are positioned under the bottom surface of guide rail 108 when the central channel or groove 109 is positioned over the top end of the central portion 202.

FIG. 4B illustrates a second roofing profile 210 also having a central portion 212 that extends vertically from horizontally oriented flanges. Central portion 212 has a hooked configuration. As with the previous profile 200, the central channel or groove 109 of guide rail 108 is configured to be positioned over the top end of central portion 212. Similarly, the horizontally oriented flanges of roofing profile 210 are positioned under the bottom surface of guide rail 108 when the central channel or groove 109 is positioned over the top end of central portion 212. Positioning the central channel or groove 109 over the top end of the central portion, 202 or 212, allows the guide rail 108, and therefore guide 100, to slide along and maintain contact with the roofing profile, 200 or 210, thereby maintaining the orientation of the guide 100 relative to the roofing profile 200 or 210. Additional details of the roofing profiles are provided in U.S. patent application Ser. Nos. 12/721,694 and 14/045,028 incorporated by reference herein.

Figure 5:
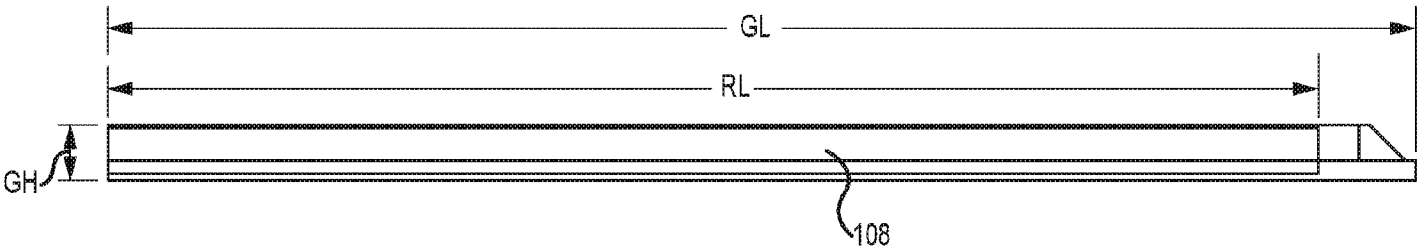
FIG. 5 illustrates a side view of the guide of FIG. 1.
Figure 6:
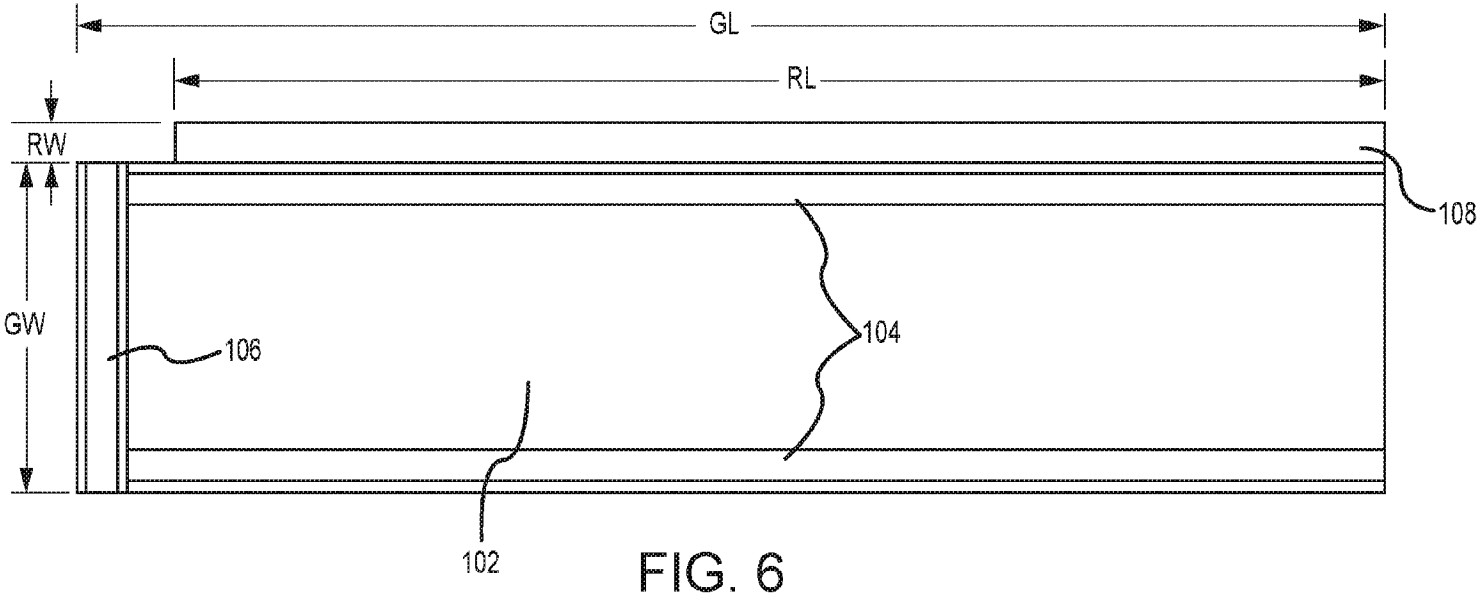
FIG. 6 illustrates a top view of the guide of FIG. 1.
Figure 7:
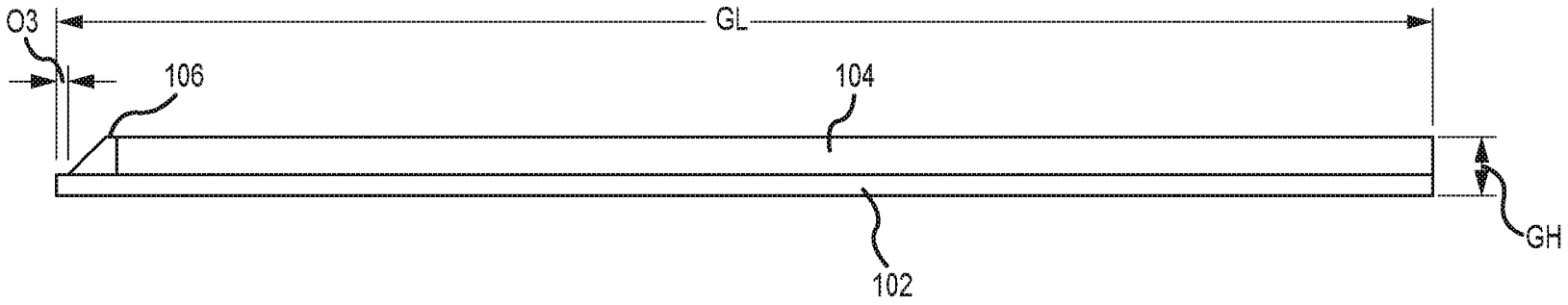
FIG. 7 illustrates an opposite side view of the guide of FIG. 1.

FIGS. 5 and 7 illustrate side views of the guide 100. FIG. 6 illustrates a top view of the guide 100. FIGS. 5 and 6 illustrate that in some embodiments the guide rail 108 extends along a majority of the longitudinal side of the guide 100, but along less than the entire length of the guide 100. For example, guide 100 may have a length GL that is longer than a length RL of the guide rail 108. The length GL of the guide 100 and/or length RL of the guide rail 108 may be selected based on the application or use of the guide 100. In some embodiments, the guide 100 may have a length GL of between 20 and 60 inches, and the guide rail 108 may likewise have a length RL of between about 20 and 60 inches. In some embodiments, the length RL of the guide rail 108 may be between 2 and 10 inches shorter than the length GL of the guide 100. In a specific embodiment, the length RL of the guide rail 108 may be between 3 and 5 inches shorter than the length GL of the guide 100. Extending the guide rail 108 along a majority of the length of the guide 100 as described above may enable greater contact between the guide rail 108 and an attached roofing profile, which may minimize rotation or other misalignment of the guide rail 108 and/or guide 100 relative to the attached roofing profile. This may aid in maintaining a proper and correct orientation of the guide 100 relative to the roofing profile as the guide 100 is moved along the roof surface, which may ensure proper alignment of additional roofing profiles atop the roof surface. As shown in FIG. 7, in some embodiments the front tapered rail 106 may be offset O3 from the front surface of the guide 100, such as by about ¼ inch and typically less than ½ inch.

The guide 100 and/or one or more components used thereon may be constructed of a variety of available materials, such as wood, fiberglass, and the like. If plywood is used for the bottom skid 102, a grade with an "A" side should be positioned to face the roof surface. Fasteners that are used in constructing the guide 100 should be countersunk on the bottom surface of the skid 102 to prevent damaging the roof surface, such as a thermoplastic roof membrane (e.g., TPO, PVC, and the like). The guide 100 is constructed to withstand continuous stress and rigorous use.

Figure 8:
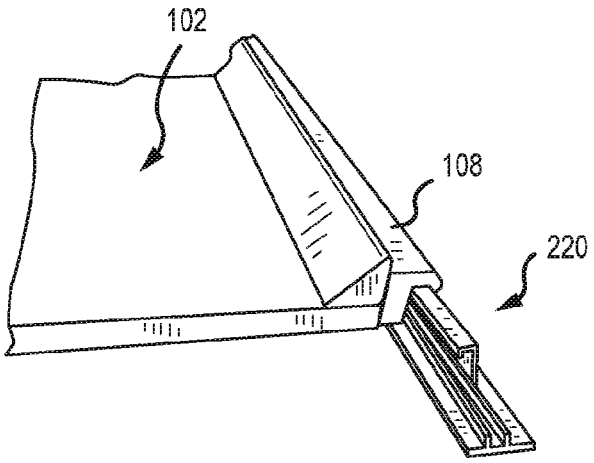
FIGS. 8 and 9 illustrate perspective view of the guide of FIG. 1 positioned atop a roofing profile.
Figure 9:
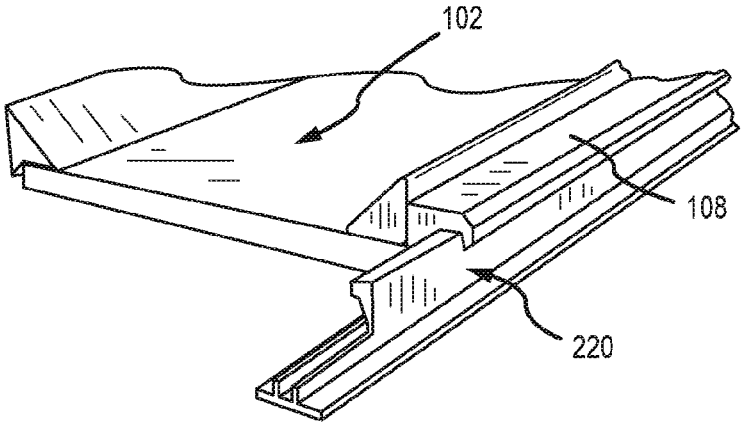

Referring now to FIGS. 8 and 9, illustrated is a guide 100 positioned in contact with a roofing profile 220 that is attached to a roof surface. Specifically, the guide rail 108 of guide 100 is positioned so that the hooked or curved end is positioned over a top end of the roofing profile 220. The top end of the roofing profile 220 is positioned within the central channel or groove 109 of the guide rail 108. The bottom skid 102 is positioned in contact within the roof's surface. With the guide rail 108 positioned over the roofing profile 220, the bottom skid 102 is able to be pulled along the roof's surface while maintaining contact with the roofing profile 220 and while maintaining an orientation relative thereto atop the roof surface.

Figure 10:
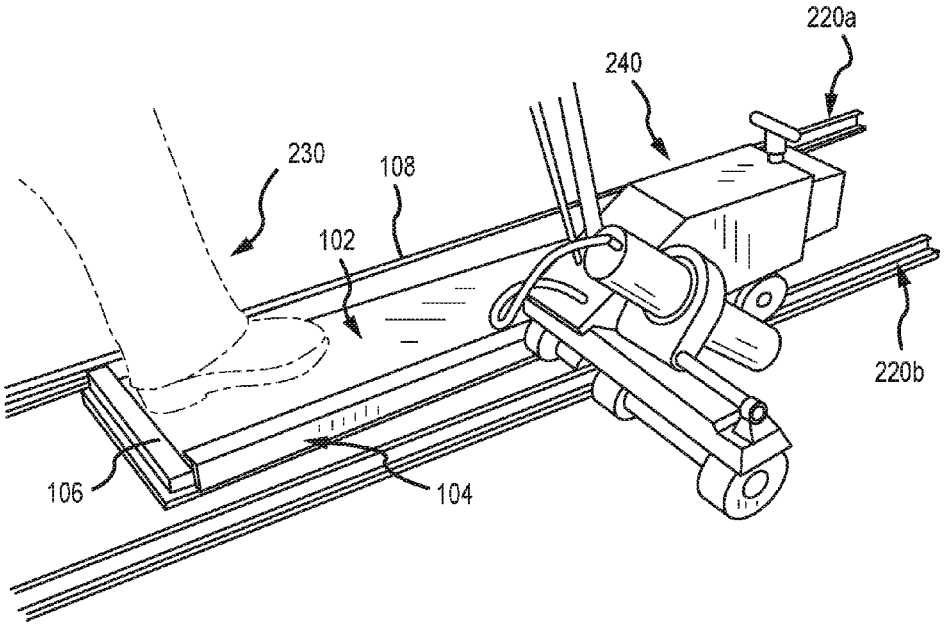
FIG. 10 illustrates a perspective view of the guide of FIG. 1 positioned atop a first roofing profile during alignment and/or installation of a second roofing profile atop a roof surface.

FIG. 10 illustrates a guide 100 positioned over and in contact with a first roofing profile 220*a* as illustrated in FIGS. 8 and 9. FIG. 10 further illustrates a profile installation machine 240 that is positioned adjacent the longitudinal side 104 of the guide 100 opposite the guide rail 108. Specifically, a side or member of the installation machine 240, such as a side wall or alignment member, contacts and abuts the longitudinal side 104 of the guide 100 opposite the guide rail 108. Contact between the installation machine 240 and the guide 100 maintains an orientation of the installation machine 240 relative to the first roofing profile 220*a* and guides the installation machine 240 along the guide 100 and about the roof surface during installation of a second roofing profile 220*b*. During installation, the installation machine 240 may move longitudinally along the longitudinal side 104 of guide 100, which properly aligns installation machine 240 and the second roofing profile 220*b* with respect to the first roofing profile 220*a*. When the installation machine 240 is close to the proximal end of the guide 100, the installer may move and slide the guide 100 along the roof surface and about the first roofing profile 220*a* by positioning the heel of his or her foot 230 (or another body or other member) against the inner surface of the front rail 106 and pulling the bottom skid 102 proximally along the roof's surface. The guide 100 may be moved and repositioned proximally along the roof surface and the installation machine 240 subsequently or continually moved atop the roof surface to align the second roofing profile 220*b* relative to the first roofing profile 220*a* and/or couple the second roofing profile 220*b* to the roof surface. As shown in FIG. 10, the length GL of guide 100 is typically long enough that the installation machine 240 may be moved longitudinally along the guide 100, but short enough that the guide 100 is easily slidable and maneuverable atop the roof surface with a heel 230 or other member. As will be readily understood with references to the figures and the description provided herein, guide 100 is especially useful for aligning adjacent roofing profiles in a parallel configuration or orientation.

As is known in the art, the installation machine 240 may have a heat gun or other component that is positionable under the horizontal flanges of the roofing profile and that delivers hot air to the roofing profile and roofing membrane to couple the components together. The installation machine 240 may also include a drive wheel that automatically moves the installation machine 240 atop the roof surface and/or include an alignment wheel or other member that aligns the second roofing profile 220*b* atop the roof surface. The installation machine 240 may include other components, or exclude some of those described herein as is known in the art. For example, the installation machine 240 may include another roofing profile coupling component and/or other types or drive or alignment mechanisms. In some embodiments, the second roofing profile 220*b* may be positioned directly adjacent and/or in contact with the longitudinal side 104 of the guide 100. In such embodiments, the roofing profile 220*b* may be manually coupled with the roof surface, or the installation machine 240 may be used to couple the profile 220*b* with the roof surface.

For a roofing profile guide that includes a bottom skid having a front edge, a back edge, a first side edge, and a second side edge; a front rail attached to the front edge; and a guide rail attached to the first side edge; a method of attaching a roofing profile to a roof surface includes positioning the guide rail adjacent a first roofing profile that is attached to the roof surface and positioning a second roofing profile adjacent the second side edge of the roofing profile guide. The method also includes moving the roofing profile guide across the roof surface so that the guide rail of the roofing profile guide moves along the first roofing profile to maintain an orientation of the roofing profile guide relative to the first roofing profile, and aligning the second roofing profile with the first roofing profile via the second side edge of the roofing profile guide. The method further includes attaching the second roofing profile with the roof surface.

In some embodiments, positioning the second roofing profile adjacent the second side edge of the roofing profile guide includes positioning an installation machine in contact with the second side edge of the roofing profile guide and positioning the second roofing membrane in contact with the installation guide. In such embodiments, the second roofing profile may be attached with the roof surface via the installation machine. In some embodiments, the guide rail includes a hooked or curved top end and positioning the guide rail adjacent the first roofing profile includes positioning the hooked or curved top end atop the first roofing profile. In some embodiments, moving the roofing profile guide across the roof surface includes contacting the front rail of the roofing profile guide with a foot or other object.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A roofing profile installation guide comprising:

a rectangular bottom skid having a front edge, a back edge, and opposing longitudinal side edges;

a first tapered side rail and a second tapered side rail, said first and second tapered side rails being attached to the opposing longitudinal side edges of the rectangular bottom skid;

a tapered front rail attached to the front edge of the rectangular bottom skid; and a guide rail attached to the first tapered side rail, said guide rail being configured to contact a first roofing profile attached to a roof surface as the rectangular bottom skid moves atop the roof surface in order to maintain an orientation of the rectangular bottom skid relative to the first roofing profile and thereby, via the second tapered side rail, align a second roofing profile with the first roofing profile atop the roof surface, said second roofing profile being unattached to the roof surface.

2. The roofing profile installation guide of claim 1, wherein a bottom surface of the guide rail is offset from a bottom surface of the rectangular bottom skid.

3. The roofing profile installation guide of claim 1, wherein a top surface of the guide rail is offset from a top surface of the first tapered side rail.

4. The roofing profile installation guide of claim 1, wherein the guide rail has a hooked or curved profile that allows the guide rail to be positioned over a top end of the first roofing profile.

5. The roofing profile installation guide of claim 1, wherein a tapered portion of the first and second tapered side rails tapers inward toward a center of the rectangular bottom skid.

6. The roofing profile installation guide of claim 1, wherein a tapered portion of the tapered front rail tapers outward away from a center of the rectangular bottom skid such that an inward facing surface of the tapered front rail is configured to be contacted by a foot of a user to move the rectangular bottom skid atop the roof surface.

7. The roofing profile installation guide of claim 1, wherein an outer surface of the second tapered side rail is configured to contact an installation machine that couples the second roofing profile with the roof surface.

8. The roofing profile installation guide of claim 7, wherein the outer surface of the second tapered side rail is orthogonal with a bottom surface of the rectangular bottom skid.

9. A roofing profile guide comprising:

a bottom member having a front edge, a back edge, a first side edge, and a second side edge positioned opposite the first side edge;

a front rail attached to the front edge of the bottom member so as to extend upward from the bottom member when the bottom member is positioned against a roof surface;

a guide rail attached to the first side edge of the bottom member, said guide rail including a hooked or curved member that extends upward from the bottom member and laterally outward from the first side edge of the bottom member, said hooked or curved member being positionable atop a first roofing profile that is attached to the roof surface when said bottom member is positioned against the roof surface; and an alignment rail attached to the second side edge and extending upward from said bottom member to define a vertical surface when said bottom member is positioned against the roof surface such that as the bottom member is moved across a roof surface, said hooked or curved member of said guide rail maintains contact with said first roofing profile while said vertical surface of said alignment rail operationally contacts a second roofing profiles to maintain a lateral spacing between the first roofing profile and the second roofing profile to align the second roofing profile with the first roofing profile atop the roof surface.

10. The roofing profile guide of claim 9, wherein a bottom surface of the guide rail is offset from a bottom surface of the bottom member such that when the bottom member is positioned against the roof surface, the bottom surface of the guide rail does not contact the roof surface.

11. The roofing profile guide of claim 9, wherein the roofing profile guide further comprises a first rail that is coupled with the first side edge and a second rail that is coupled with the second side edge, and wherein the guide rail is attached to the first rail.

12. The roofing profile guide of claim 9, wherein an inward facing surface of the front rail is configured to effect movement of the bottom member across the roof surface upon contact by a user's foot.

13. The roofing profile guide of claim 9, wherein said vertical surface of said alignment rail operationally contacts the second roofing profiles via contact with an installation machine that is configured to align and couple the second roofing profile with the roof surface.

14. The roofing profile guide of claim 13, wherein the second roofing profile is laterally offset from the alignment rail via the installation machine.

15. A method of attaching a roofing profile to a roof surface comprising:

for a roofing profile guide that includes:

a bottom skid having a front edge, a back edge, a first side edge, and a second side edge;

a front rail attached to the front edge; and a guide rail attached to the first side edge;

positioning the guide rail of the roofing profile guide adjacent a first roofing profile that is attached to the roof surface;

positioning a second roofing profile adjacent the second side edge of the roofing profile guide;

moving the roofing profile guide across the roof surface so that the guide rail of the roofing profile guide moves along the first roofing profile so as to maintain an orientation of the roofing profile guide relative to the first roofing profile;

aligning the second roofing profile with the first roofing profile via the second side edge of the roofing profile guide; and attaching the second roofing profile with the roof surface.

16. The method of claim 15, wherein positioning the second roofing profile adjacent the second side edge of the roofing profile guide comprises positioning an installation machine in contact with the second side edge of the roofing profile guide and positioning the second roofing profile in contact with the installation machine, and wherein the second roofing profile is attached with the roof surface via the installation machine.

17. The method of claim 15, wherein the guide rail includes a hooked or curved top end and wherein positioning the guide rail adjacent the first roofing profile comprises positioning the hooked or curved top end atop the first roofing profile.

18. The method of claim 15, wherein moving the roofing profile guide across the roof surface comprises contacting the front rail of the roofing profile guide with a foot or other object.

19. The method of claim 15, wherein a bottom surface of the bottom skid includes wheels or a material having a low coefficient of friction.

* * * * *